US005938156A

United States Patent [19]

Kao

[11] Patent Number: 5,938,156

[45] Date of Patent: Aug. 17, 1999

[54] WOOD GRAIN FINISH CLADDING ASSEMBLY OF CHAIR BASES

[76] Inventor: Hsin-Lin Kao, No. 161-6, Community 20, Lu Chu Ts'un, Lu Chu Hsiang, Taoyuan Hsien, Taiwan

[21] Appl. No.: 09/095,559

[22] Filed: Jun. 11, 1998

[51] Int. Cl.[6] ..... A47B 91/00

[52] U.S. Cl. ..... 248/188.7

[58] Field of Search ..... 248/188.7, 345.1, 248/345; 297/452.38

[56] References Cited

U.S. PATENT DOCUMENTS

| | | | |
|---|---|---|---|
| 3,617,023 | 11/1971 | Schneiderman | 248/188.7 |
| 5,048,780 | 9/1991 | Borsani | 248/188.7 |
| 5,402,973 | 4/1995 | Haines | 248/188.7 |

*Primary Examiner*—Derek J. Berger
*Assistant Examiner*—Michael Nornberg
*Attorney, Agent, or Firm*—Rosenberg, Klein & Bilker

[57] ABSTRACT

A structure for assembling chair bases by cladding the chair bases with wood grain finish strips is provided. The chair bases have notched slots formed at appropriate placed on both sides of each plastic strut foot. A scoop channel is formed in the strut foot surface near the central pivot joint of the base. A drilled hole is located inside the scoop channel. A connecting hole is formed in the outer bottom edge of each strut foot for attaching a wheel set thereto. There is a wood grain finish strip for each strut foot. Each strut foot has an inverted U-shaped cross-sectional contour and pintle hooks located in correspondence with the notched slots on both sides of each strut foot. The outer bottom edge of each wood grain finish strip extends inwardly to form a flange of suitable length to extend over the outside of the strut foot.

1 Claim, 6 Drawing Sheets

WOOD GRAIN FINISH CLADDING ASSEMBLY OF CHAIR BASES

FIELD OF THE INVENTION

This invention relates to the improvement of the structure of chair bases by the addition of wood grain finish strips, in particular, to a cladded assembly of wood grain finish strips secured over the strut base for quality feel and matching the appearance of other office furniture.

PRIOR ART

For an office chair (C) of the prior art, the structure, based on consideration of convenience, mostly belongs to the type shown in FIG. 1. The chair base (A) required for stability and movability, is made from 5 to 6 strut foot pieces with an attachment of wheels (B). Some of these chairs use all metal construction for the chair bases, but the heavy weight and difficulty transporting it have restricted its marketing. A one piece injection molded plastic chair base with wheels is preferred. This trend has encouraged mass production with faster production capacity and cheaper prices in comparison to bases of metallic construction, and thus have a better competitive potential in the market.

However, the chair bases made from plastic injection molding lack the aesthetic appearance and quality feel of real wood construction, despite the advantages in production rate and cost. If the chair base in FIG. 1 was made of real wood, not only would the production rate be slower and the price higher, but also, most importantly, the safety and loading capacity of the chair cannot meet certain requirements in many countries, countries that have adapted a gravity test using free falling method. Thus, chair bases made from real wood cannot pass the test and cannot be considered for use as office furniture.

Some manufacturers have tried to fabricate chair bases with natural wood grain, however, due to the single piece construction with several strut feet and a curvature thereof, it cannot be included in the injection molding process for actual production, as in the simple case of imitation wood grain panels in autos. The use of printing or adhering of an overlay, at present, is not practical due to a lack of quality.

This inventor had attempted to use bolts for fixing wood grain strips to the surface of a chair base (A) for providing a pleasing aesthetic appearance, but it was not successful. In carrying the load of a person, their weight is evenly distributed onto each strut foot (D). The drilling of a hole on any position around (D) can severely damage the strength of the chair base (A). During a gravity test, the strain developed around the hole in (D) can cause breakage and thereby become unsafe for use.

SUMMARY OF THE INVENTION

The main purpose of this invention is to provide a structure to improve the quality feel and overall look of chair bases with a wood grain finish cladding assembly for chair bases.

Another purpose of this invention is to provide a convenient assembly procedure for the wood grain finish cladding assembly for chair bases with proper structural strength for absolute safety.

A further aspect of this invention is to provide a structure of the wood grain finish cladding assembly for chair bases that is in harmony with arm rests of chairs and other office furniture.

BRIEF DESCRIPTION OF THE DRAWINGS

An embodiment of the invention will now be described by way of the illustrated drawings with reference to FIG. 1 is a schematic diagram of a chair base for an office chair of the prior art.

DETAILED DESCRIPTION OF THE PREFERRED EMBODIMENT

Figure 5:
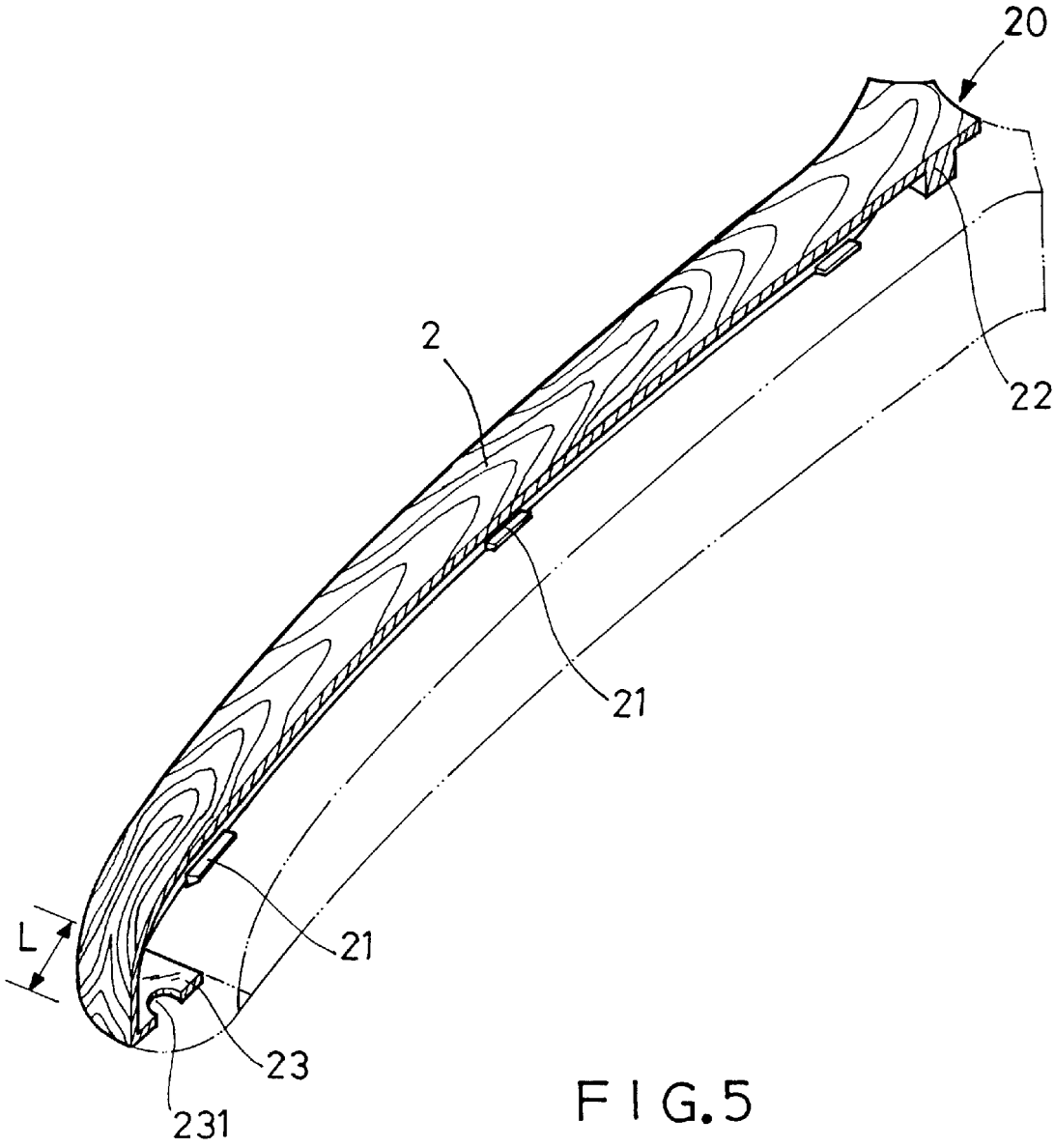
FIG. 5 is a longitudinally sectioned view of a wood grain finish strip of the present invention.
Figure 6:
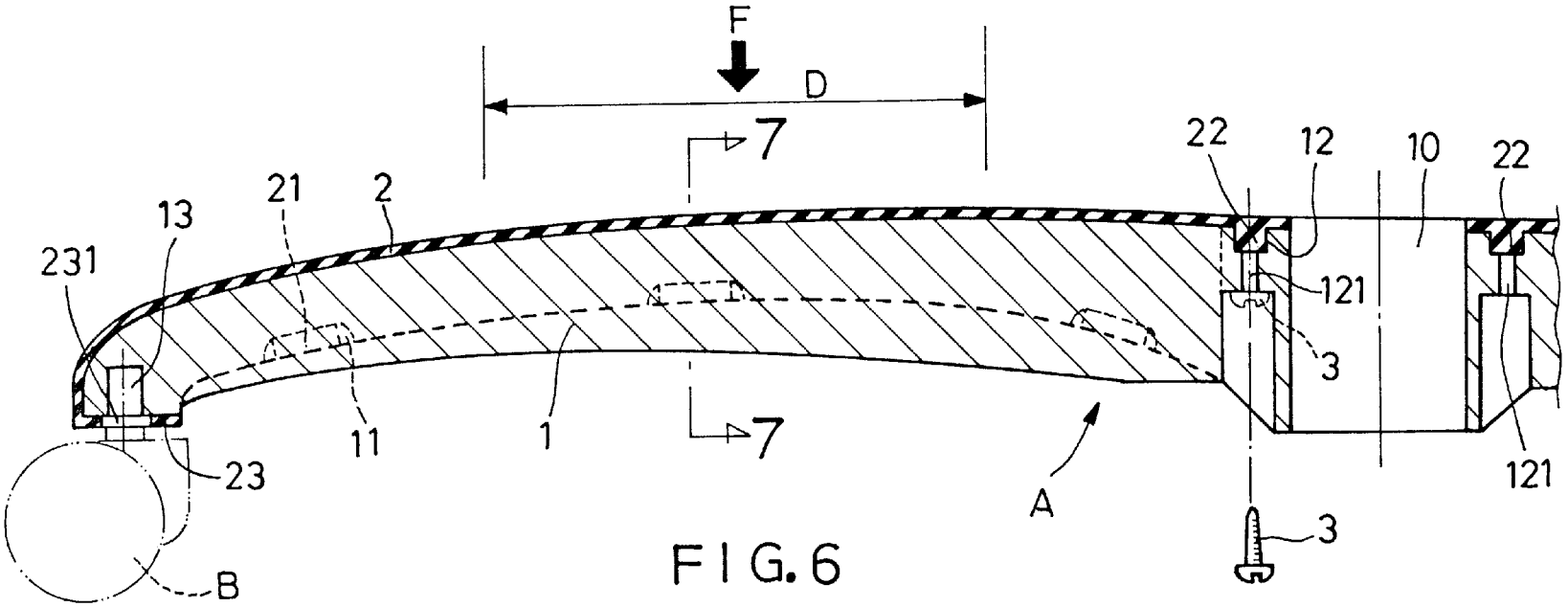
FIG. 6 is a longitudinally sectioned view of a wood grain finish strip and a strut foot assembly of the present invention.

Referring to FIGS. 2–6, there is provided a structure of a wood grain finish cladding assembly for a chair base A. The preferred assembly consists of: notched slots 11 formed at appropriate places on both sides of each plastic strut foot 1 during injection molding; a scoop channel 12 formed on the surface near the central hollow pivot joint 10 of each strut foot 1; a drilled hole 121 inside the scoop channel, as shown in FIG. 6; and, a connecting hole 13 formed on the outer bottom edge 23 of each strut foot 1 for attaching a wheel set B thereto, as shown in FIG. 6.

Figure 1:
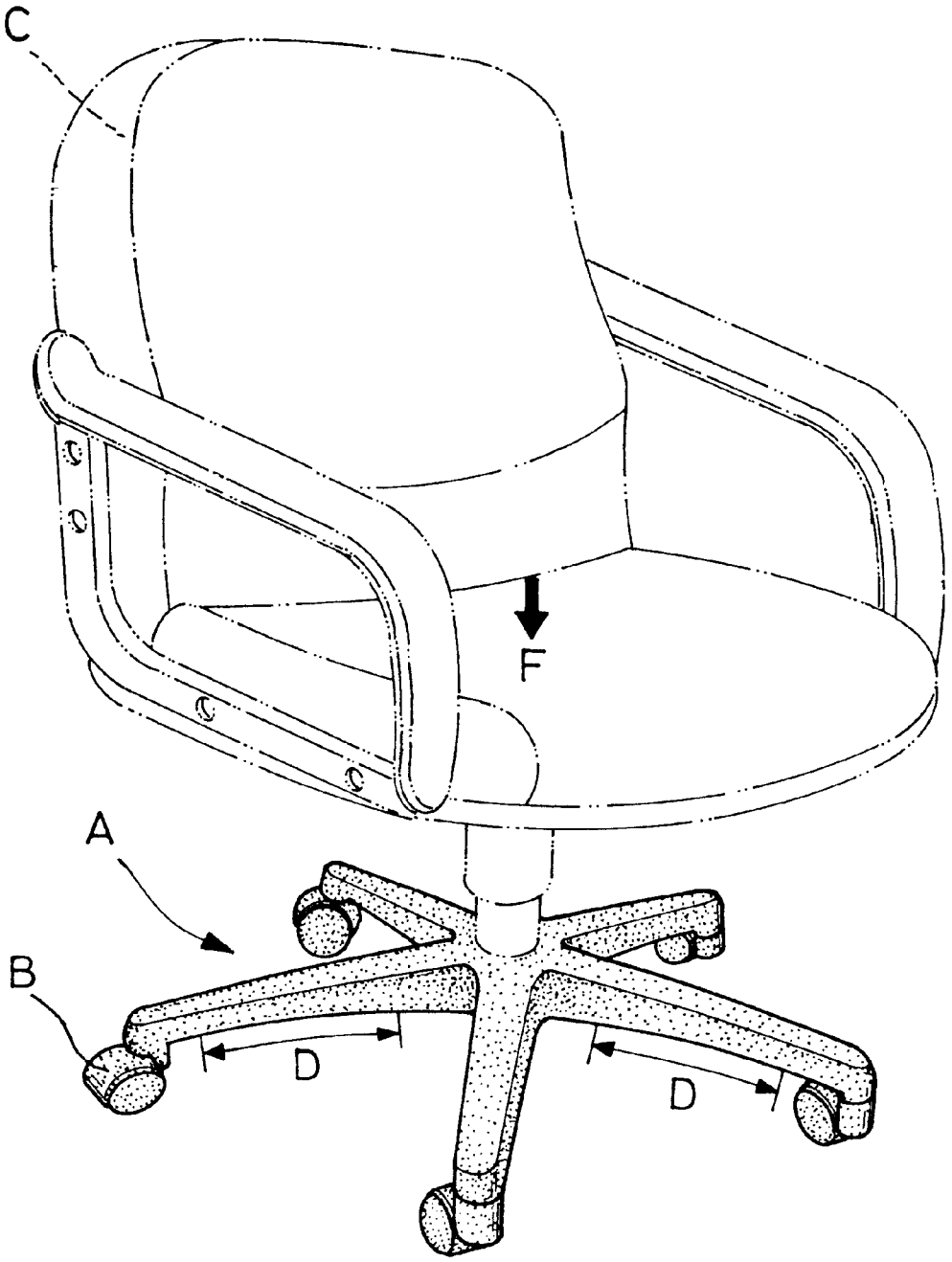
PRIOR ART FIG. 1
Figure 3:
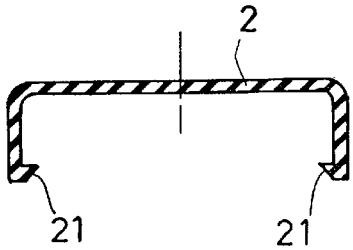
FIG. 3 is a cross-sectional view of a wood grain finish strip taken along the section line 3—3 in FIG. 2.
Figure 4:
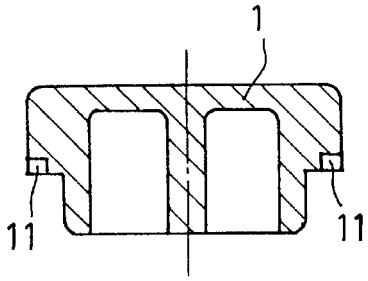
FIG. 4 is a cross-sectional view of a strut foot taken along the section line 4—4 in FIG. 2.
Figure 2:
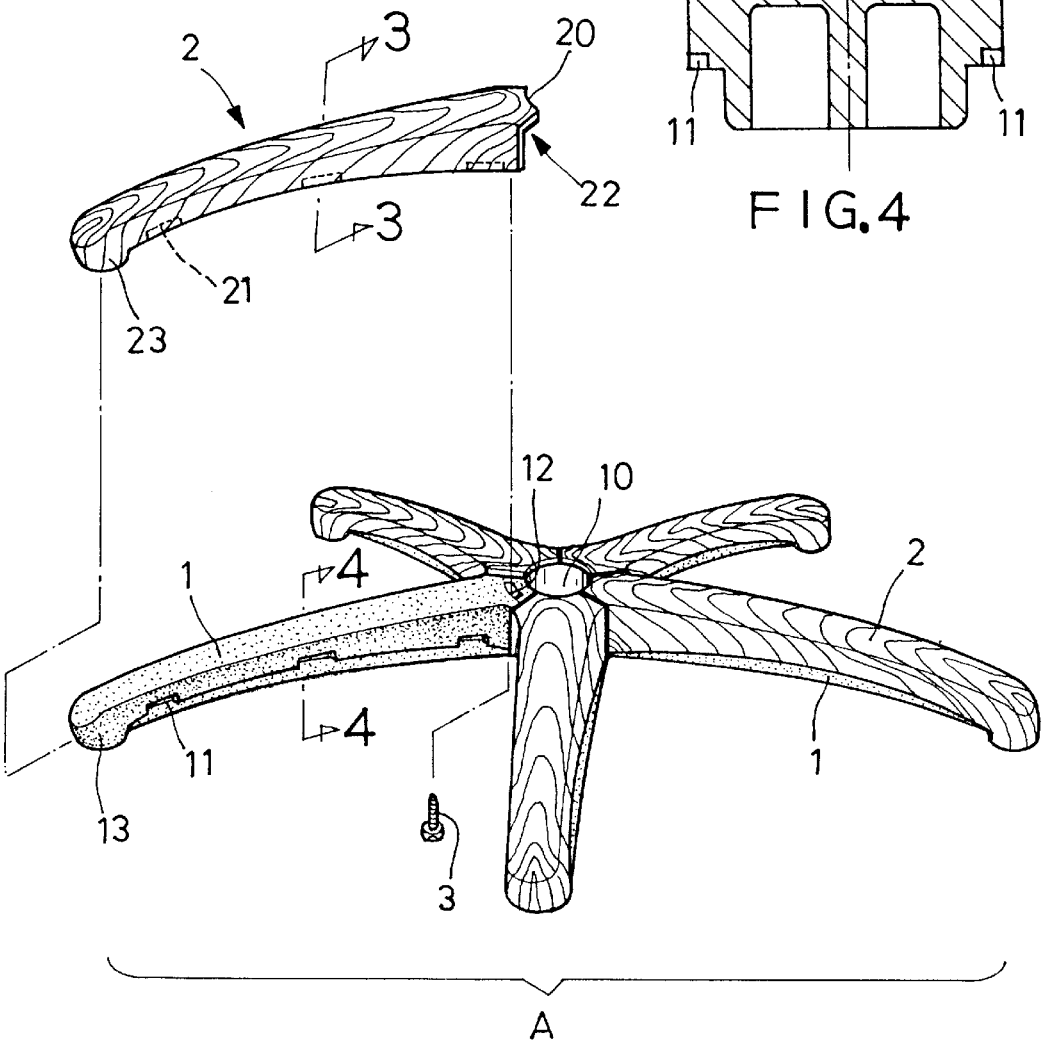
FIG. 2 is a perspective exploded view of a preferred assembly of a wood grain finish strip to a chair base of the present invention.
Figure 8:
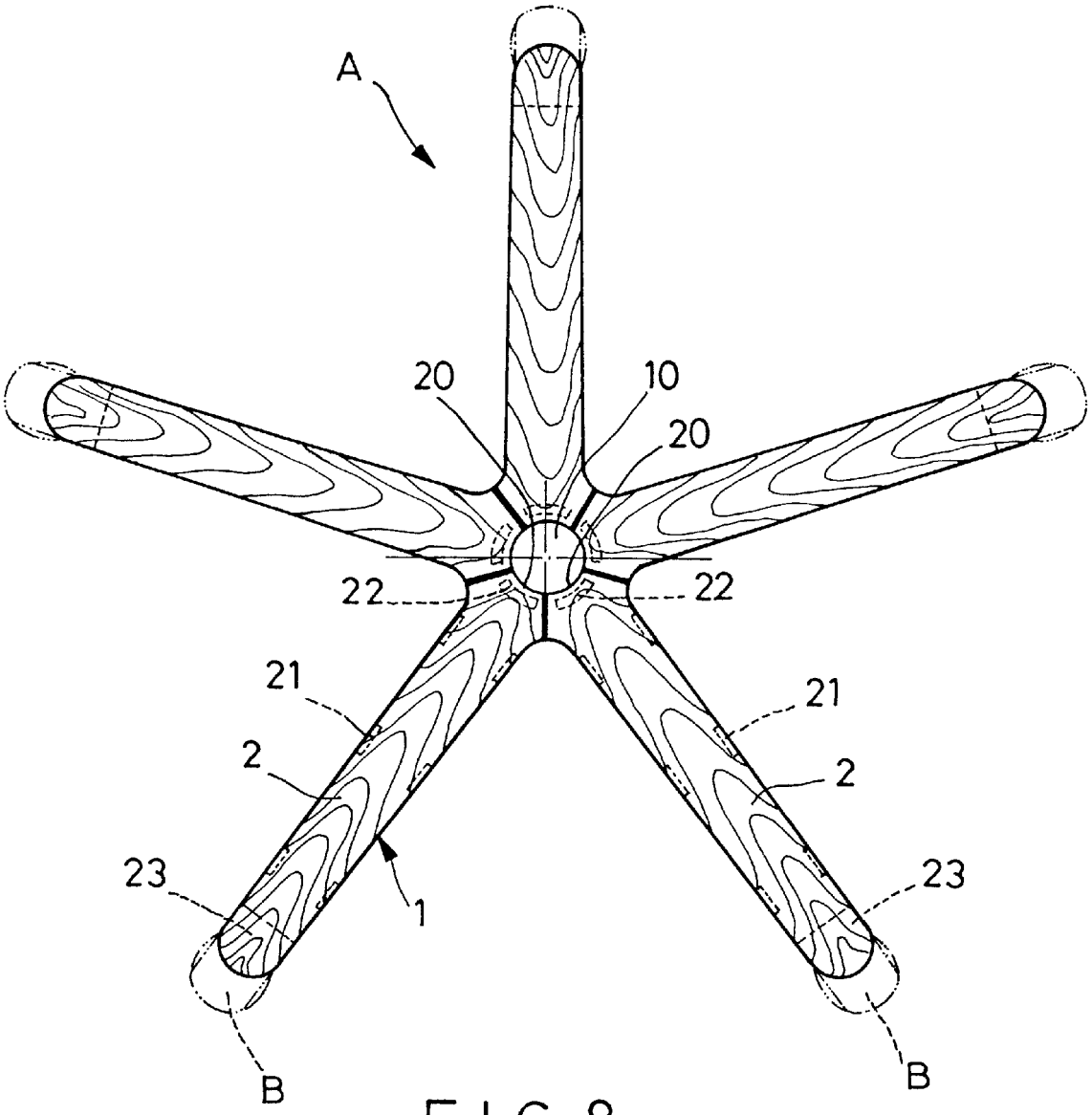

Wood grain finish strips 2 of a size and curvature that corresponds to each strut foot 1 are provided, the cross-section of which has an inverted U-shape contour, as shown in FIG. 3. Pintle hooks 21 are located opposite to the notched slots 11 on both sides of each strut foot 1. The pintle hooks 21 are inserted into the corresponding notched slots 11 for fixing the wood grain finish strips 2 to the strut feet 1. Further, as shown in FIG. 2, FIG. 5 and FIG.8, the inner side 20 of the wood grain finish strip 2, corresponding to the hollow pivot joint 10, has an arcuate shaped contour. In correspondence to the scoop channel 12 of the strut foot 1, the wood grain finish strips have a fixing part 22 that is inserted into a respective scoop channel 12. Further, the outer bottom edge of the end 232 of each wood grain finish strip 2 extends inwardly a suitable length L to form a flange 23 to be cladded over the outside of the distal end 131 of the strut foot 1. A circular connection hole 231 is formed in the flange 23 in alignment with the hole 13 on the bottom of the strut foot 1. A screw 3 is inserted into the drilled hole 121, from the bottom up, into the fixing part 22 of the wood grain finish strip 2.

Thus, the wood grain finish strip 2 can be quickly cladded over the surface of each strut foot 1 in one piece.

Each of the wood grain finish strips 2 can be fabricated from real wood, or with a wood grain finish overlay on a plastic substrate. However, the quality feel of the former type is excellent, with better strength and cheaper production cost in comparison to the whole strut foot being made from real wood.

As previously discussed, it is difficult to provide a wood grain finish directed during plastic molding of chair bases. The use of plastic strips or sheets with a wood grain finish has been known in the art, as in the imitated wood panels in autos. Thus, the present invention has utilized the presently available art to apply a decoration to a plastic substrate, the surface finish being in the form of wood grain finish strips. Each wood grain finish strip has a U-shaped cross-section and pintle hooks to clampingly and tightly fix the wood grain finish strips onto the chair base.

Figure 7:
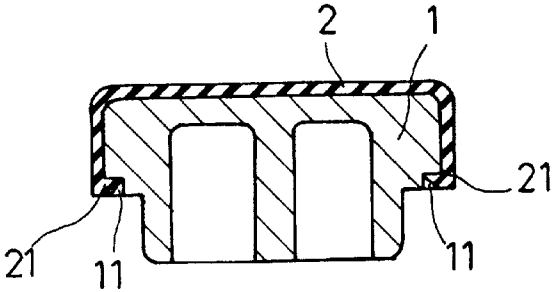
FIG. 7 is a cross-sectional view of the assembly of FIG. 6 taken along the section line 7—7; and, FIG. 8 is a top view of the wood grain finish strip cladding assembly of the present invention; and, FIG. 9 is a perspective view of an assembled chair of the present invention.

The assembly work of the present invention is indicated in FIGS. 2, 6 and 7. First, before attaching a wheel set, the flange 23 is placed over the bottom edge of the end 232 of strut foot 1. Irrespective of the materials of the strips being real wood or a plastic substrate, the strips have a certain flexibility, to be stretched out with the pintle hooks engaging the notched slots 11. The fixing part 22 on the inner bottom side of the strip 2 is also inserted into the scoop channel 12, to quickly combine the wood grain finish strip 2 with the strut foot 1 in the form of a single piece. Since the wood grain finish strips 2 have a U-shaped cross-sectional contour with pintle hooks 21, along with a flange 23 and inner fixing part 22, the cladding of the chair base can be accomplished neatly.

From another aspect, this invention provides for tightening of the screws 3, from the bottom up through respective hole 121 near the pivot joint 10, to engage with the bottom of the fixing part 22, to prevent displacement of the fixing part 22 in the vertical direction.

It should be emphasized at this point, that the hole 121 in the strut foot 1 is located near the edge of the hollow pivot joint 10, since this location is not a high stress (load) region. The small hole does not influence the overall strength of the base. When the chair is loaded, the force thereof F is evenly distributed over the D-region of each strut foot 1. However, in this D-region there are no holes, and any strain is not coupled to the strips 2. During gravity tests, no breakage occurs around that region, to ensure its application in production meets safety standards.

FIG. 8 shows the top view of the assembly by this invention. If the chair base has 5 sets of strut feet, then the inner side 20 will form ⅕ of 360°. After assembly, these five pieces of wood grain finish strips form a circle to provide a smooth appearance.

Figure 9:
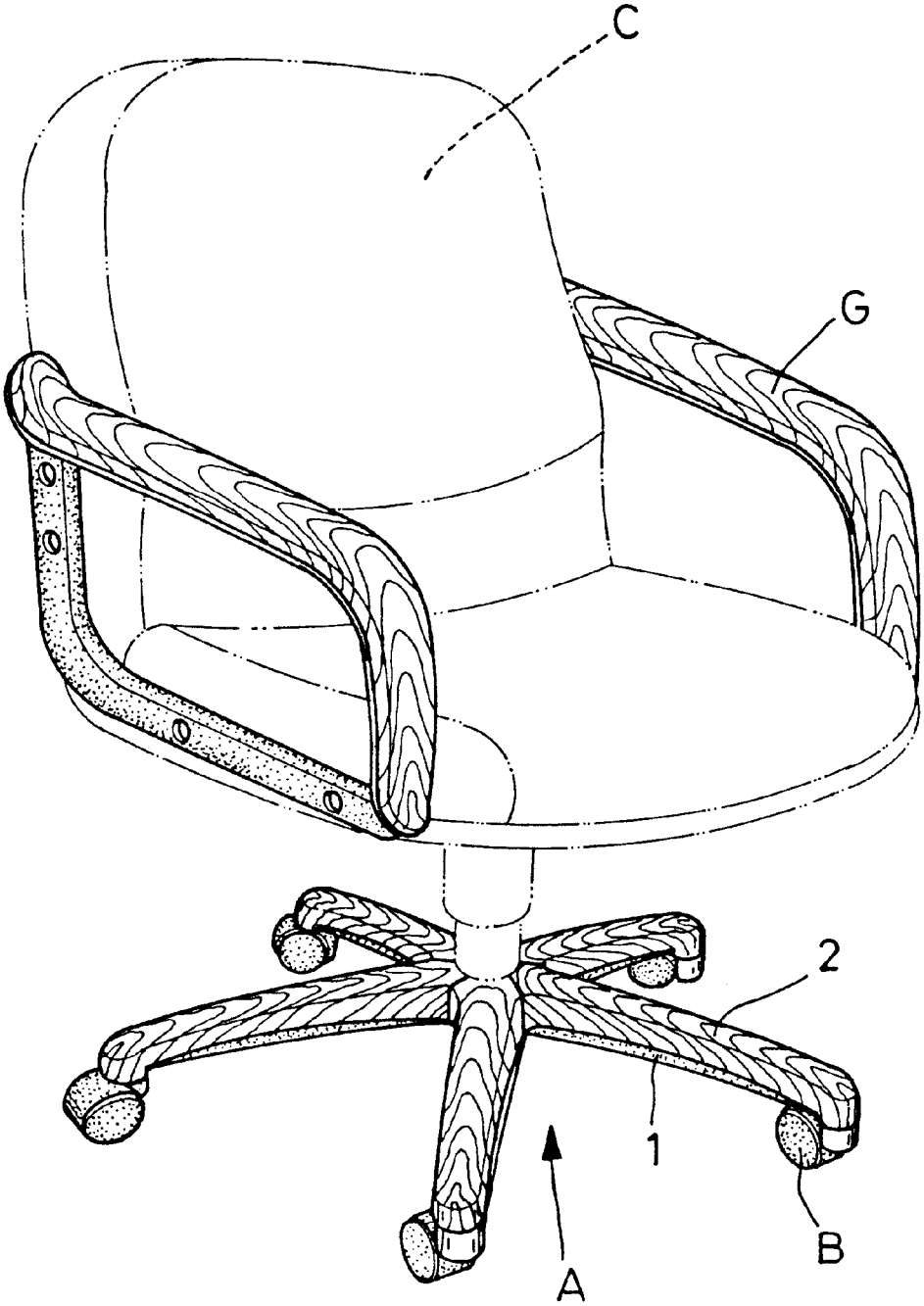

FIG. 9 shows the appearance of an assembled chair in accordance with this invention. From it one can visualize the characteristics of this invention, in which the original monotonous feature of a chair base A has become beautified to show a feeling of quality of the chair C. Furthermore, the strips can match the design of wooden arm rests G or be in harmony with other wood furniture. Thus, chair bases developed in accordance with this invention can retain the strength of plastics, are suitable for mass production, and have a quality feel of wood grain.

The illustrations and descriptions of this invention, as disclosed above, consist of a preferred embodiment thereof, however, it is evident that many alternatives, modifications and variations will be apparent to those skilled in the art in light of foregoing description. Accordingly, it is intended that this invention embrace all such alternatives, modifications and variations as fall within the spirit and broad scope of the appended claim.

What is claimed is:

1. A structure for providing a chair base with a wood grain cladding, comprising:

a chair base having a centrally disposed pivot joint and a plurality of plastic strut feet extending radially outward from said pivot joint, each of said strut feet having a plurality of notched slots formed in opposing sides thereof and a scoop channel formed in an upper surface adjacent said pivot joint, each said strut foot having a connecting hole formed in a lower surface of a distal end thereof for receiving a wheel set therein, said scoop channel having a bottom surface with a hole passing therefrom to a bottom surface of said strut foot; and, a plurality of wood grain finish strips respectively coupled to said plurality of strut feet in overlaying relationship, each of said plurality of wood grain finish strips having an inverted U-shaped cross-sectional contour, a plurality of inwardly directed pintle hooks for respective insert into said plurality of notched slots of a respective strut foot, and a fixing part inserted into said scoop channel, said fixing part being affixed within said scoop channel by a screw passing through said hole in said bottom surface of said scoop channel, each said wood grain finish strip having a flange formed on a bottom portion of a distal end thereof with a hole formed through said flange in alignment with said connecting hole for encompassing said distal end of a respective strut foot.

* * * * *